US005583945A

United States Patent [19]

Iijima et al.

[11] Patent Number: 5,583,945

[45] Date of Patent: Dec. 10, 1996

[54] SPEAKER WITH A MOLDED PLASTIC FRAME INCLUDING A POSITIONING PROJECTION, AND A METHOD FOR MANUFACTURING THE SAME

[75] Inventors: Toshihito Iijima, Yamanashi; Toshifumi Fukawatase, Tokyo, both of Japan

[73] Assignee: Minebea Co., Ltd., Nagano-Ken, Japan

[21] Appl. No.: 223,506

[22] Filed: Apr. 6, 1994

[30] Foreign Application Priority Data

Apr. 7, 1993 [JP] Japan ..... 5-104975

[51] Int. Cl.[6] ..... H04R 25/00

[52] U.S. Cl. ..... 381/199; 381/188; 381/205; 381/204; 381/201

[58] Field of Search ..... 381/199, 192, 381/201, 194, 195, 204, 188, 205; 181/171

[56] References Cited

U.S. PATENT DOCUMENTS

| | | | |
|---|---|---|---|
| 4,234,766 | 11/1980 | Cacho | 381/194 |
| 4,465,906 | 8/1984 | Adolph et al. | 381/194 |
| 4,507,800 | 3/1985 | Kelley | 381/197 |
| 4,665,550 | 5/1987 | Haas | 381/199 |
| 5,157,731 | 10/1992 | Mitobe | 381/193 |
| 5,243,151 | 9/1993 | Prokisch | 381/188 |

FOREIGN PATENT DOCUMENTS

| | | |
|---|---|---|
| 58-171197 | 10/1983 | Japan . |
| 60-180300 | 9/1985 | Japan . |
| 63-49993 | 12/1988 | Japan . |
| 2-21998 | 2/1990 | Japan . |

*Primary Examiner*—Curtis Kuntz
*Assistant Examiner*—Sinh Tran

[57] ABSTRACT

A plastic-molded frame 3 has a bottom-closed cylindrical magnetic circuit holding portion 2 which has a positioning projection 6 provided in a central portion on a bottom surface 2*a* of the magnetic circuit holding portion 2. A magnetic circuit is incorporated in the magnetic circuit holder 2 by putting a bottom plate 9 on the bottom 2*a* such that a positioning recess 12 in the lower surface of the bottom plate 9 engages the positioning projection 6, next putting a ring-shaped magnet 13 on the bottom plate by using a magnet guide 11 on the bottom plate 9, next putting a top plate 14 on the magnet 13, and next urging the top plate 14 down and rotating it in a predetermined direction such that engaging portions 16 provided along the outer circumferential edge of the top plate 14 engage with engaging projections 8 extending from the upper open end of the magnetic circuit holder 2 and such that slanted surfaces 7 of the engaging projections 8 tightly contract the entirety of the members 14, 13, 9 in the magnetic circuit holder 2.

16 Claims, 3 Drawing Sheets

SPEAKER WITH A MOLDED PLASTIC FRAME INCLUDING A POSITIONING PROJECTION, AND A METHOD FOR MANUFACTURING THE SAME

BACKGROUND OF THE INVENTION

1. Field of the Invention

This invention relates to a speaker for use in various types of acoustic apparatuses, and more particularly, to a speaker whose speaker frame is molded of a heat resistant plastic resin and does not need any adhesive to assemble its magnetic circuit.

2. Prior Art

It has been known, for example from, Japanese Patent Laid-Open Publication Sho 58-171197, Japanese Utility Model Post-Examination Publication Sho-63-49993 and Japanese Patent Laid-Open Publication Sho 60-180300 and others, that a speaker frame may be made of polycarbonate or other engineering plastic excellent in resistance to heat, mechanical strength, resistance to abrasion, and the like.

Among them, Japanese Utility Model Laid-Open Publication Hei 2-21998 discloses an arrangement for easily assembling a magnetic circuit to a speaker frame by sequentially stacking, from the base, a lower plate, a plastic magnet, an upper plate and a frame such that coupling projections standing from the plastic magnet engage with holes provided in the other members, then heating the assembly to secure the coupling projections of the plastic magnet to the other members due to thermal fusion, and fixing the upper plate to the bottom of the plastic frame by deforming the coupling projections of the upper plate to sit on the bottom plate of the plastic frame. This technique is certainly excellent in that it can make up a speaker having a plastic frame without using an adhesive for coupling respective constituent elements.

The above technique, however, requires coupling projections standing from some locations of upper and lower surfaces of the ring-shaped plastic magnet and engaging holes provided in the upper and lower plates to receive the coupling projections. Therefore, many steps are required to prepare respective components of the magnetic circuit, and any error in positional relations between coupling projections and holes makes the assemblage of the magnetic circuit difficult.

Moreover, although the known technique does not need caulking, fixing by bolts or bonding with an adhesive, it still needs hot bonding by using a high-frequency heater, and hence requires a large-scaled apparatus in the manufacturing process. Therefore, and for other reasons, the known technique fails to reduce the cost of the speaker, which and other factors still remain as problems to be solved.

OBJECT AND SUMMARY OF THE INVENTION

It is therefore an object of the invention to provide a speaker simply and easily assembled without using an adhesive.

A speaker comprising: a plastic frame having an integrally formed bottom and a closed cylindrical magnetic circuit holding portion for holding a magnetic circuit inside said bottom, a mount portion for fixing an outer circumferential edge of a diaphragm above the magnetic circuit holding portion, and a second mounting surface for mounting of the speaker frame, said frame further having a positioning projection provided in a central portion on a bottom surface of said magnetic circuit holding portion, and a plurality of engaging projections extending from an inner surface of said magnetic circuit holding portion at an open end thereof at predetermined intervals, each of said engaging projections defining a slanted lower surface sloping down toward said bottom from one end to another; a bottom plate having a positioning recess in a central portion of a lower surface for engaging said positioning projection, a center pole in a central portion of an upper surface, and a circular rib of said upper surface to serve as a magnet guide; a ring-shaped magnet, having an inner circumferential surface engageable with said magnet guide; and a top plate having integrally formed a plurality of engaging portions horizontally extending along an outer circumferential portion for engaging with said engaging projections of the frame.

A method for manufacturing a speaker, the invention comprising the steps of: using a plastic frame having integrally formed, above a closed bottom and a closed cylindrical magnetic circuit holding portion, a first mounting portion for fixing an outer circumferential edge of a diaphragm above said magnetic circuit holding portion a plurality of engaging projections extending from an inner surface of said magnetic circuit holding portion, and a second mounting surface for enabling mounting of the frame, and a positioning projection in a central portion on a bottom surface; concentrically putting a bottom plate, which has a magnet guide in an upper surface, a positioning recess in a central portion at a bottom surface, and a center pole, by engaging said positioning recess with said positioning projection of said magnetic circuit holding portion; putting said ring-shaped magnet on the bottom plate by utilizing a magnet guide of said bottom plate; putting on said magnet a top plate having a plurality of engaging portions horizontally extending along the outer circumferential portion thereof by using said center pole as a guide such that the engaging portions of the top plate are offset in a rotational direction relative to said engaging projections and rotating said top plate in a predetermined direction with respect to the frame such that said engaging portions of the top plate engage with and move along slanted surfaces defined by lower surfaces of said engaging projections of the frame until said top plate is urged to a substantially maximum downward position and tightly holds said ring-shaped magnet in the magnetic circuit holding portion whereby a magnetic circuit formed of said bottom plate, said ring-shaped magnet, and said top plate is firmly fixed in said frame.

The frame constituting the speaker is preferably a unitary mold of pulicidal, polyamide, polycarbonate, and any other engineering plastic resin excellent in resistance to heat.

The bottom-closed cylindrical magnetic circuit holding portion has a depth slightly larger than the total thickness of the bottom plate, the magnet and the top plate.

The inner diameter of the magnetic circuit holding portion may be determined such that a predetermined distance is provided between its own inner surface and the outer circumferential margin of the top plate when the top plate is fixed therein. More preferably, however, the inner diameter may be the same as the outer diameter of the top plate such that the top plate is reliably centered by guidance of the inner surface of the magnetic circuit holding portion when the top plate is set on the magnet.

Each of the engaging projections extending from the inner circumferential surface toward the center at an upper end of the open end of the magnetic circuit holding portion has a lower surface which defines a slanted surface sloping down toward the bottom from one to the other end thereof. The height of these engaging projections is such that the magnetic circuit can be firmly fixed when the upper surfaces of the engaging portions of the top plate engage with utmost ends of the slanted surfaces.

In the speaker according to the invention, since the magnetic circuit is fixed in the magnetic circuit holding portion molded of a plastic resin by sequentially mounting the bottom plate, the ring-shaped magnet and the top plate and by rotating the top plate in a predetermined direction, the magnetic circuit can be assembled without using an adhesive, and can readily be disassembled when any defective element is found.

In the speaker manufacturing method according to the invention, after the bottom plate, the ring-shaped magnet and the top plate are sequentially mounted in the magnetic holding portion molded of a plastic resin, by rotating the top plate in a predetermined direction such that the engaging portions of the top plate are brought into contact with and slide along the slanted surfaces of the engaging projections of the frame, the top plate is urged toward the bottom and tightly fixed to the frame. Therefore, the magnetic circuit can be firmly fixed to the frame without using an adhesive.

DESCRIPTION OF THE PREFERRED EMBODIMENTS

Figure 1:
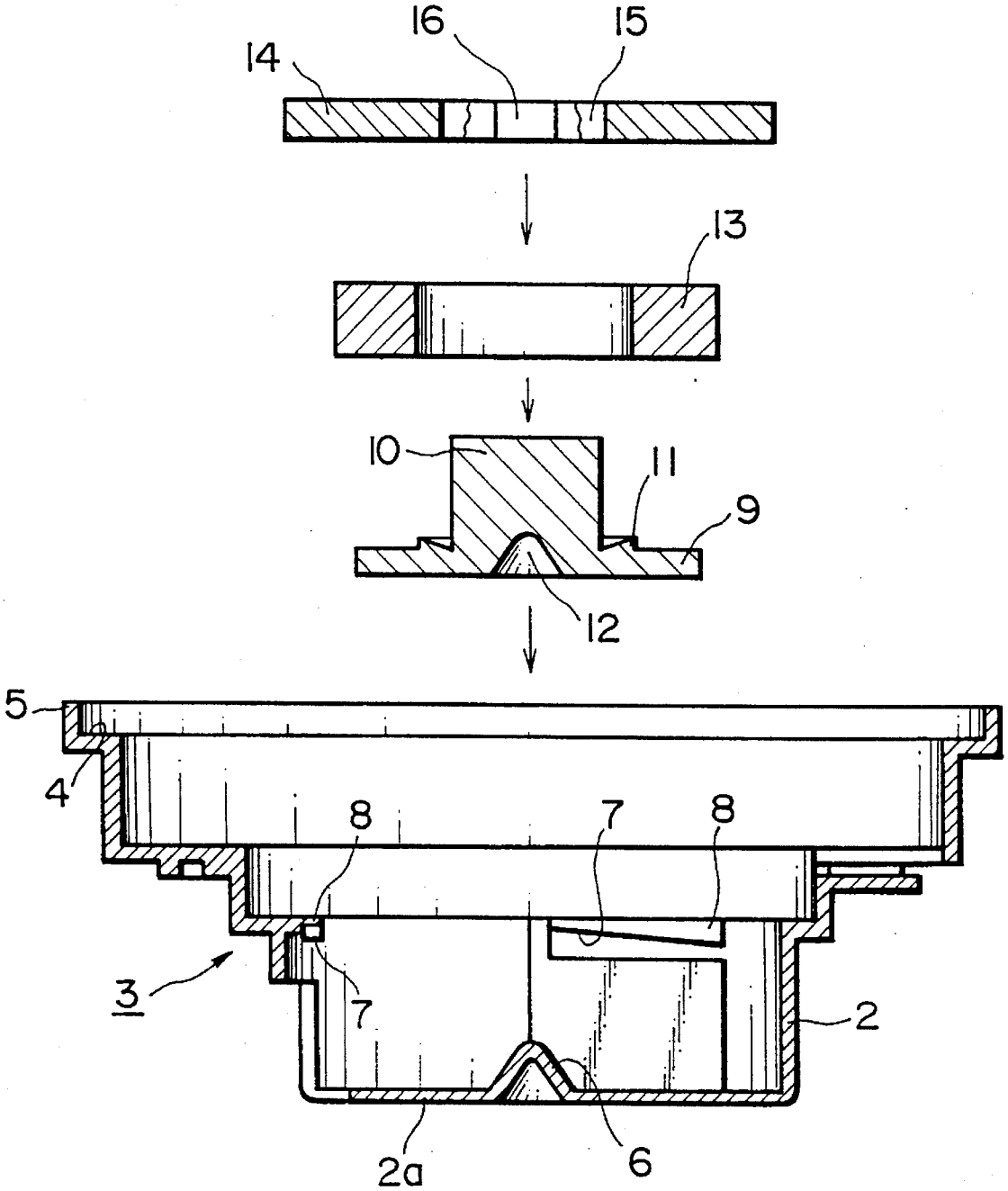
FIG. 1 is a partly cut-out exploded cross-sectional view of major components of a speaker according to the invention.
Figure 2:
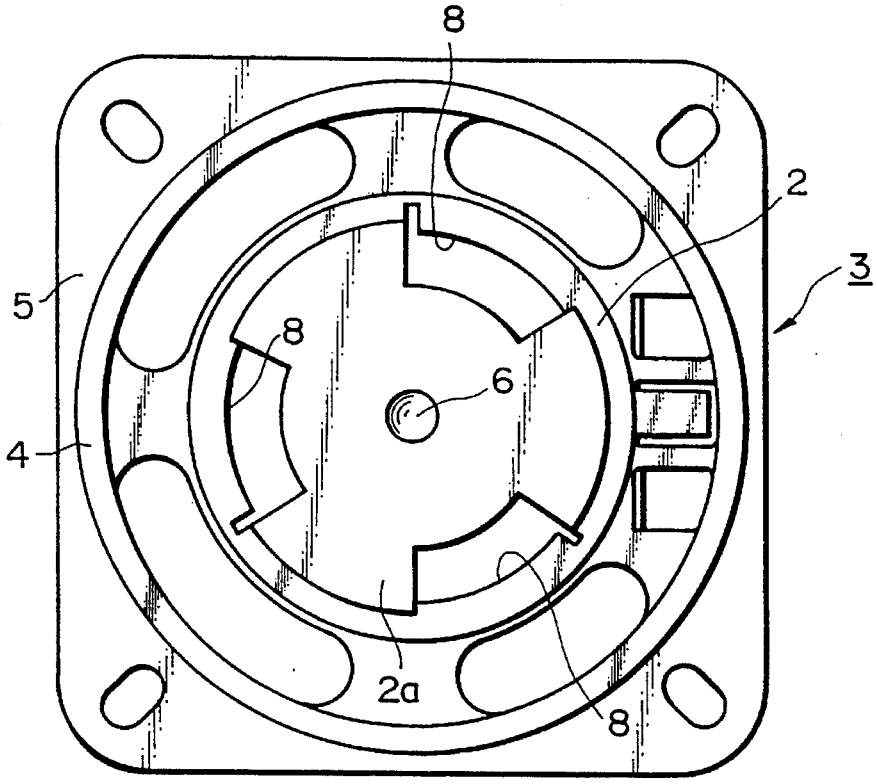
FIG. 2 is a plan view of a frame constituting the speaker.

Preferred embodiments of a speaker and its manufacturing method according to the invention are described below with reference to the drawings.

The speaker 1 according to the invention includes a plastic frame 3 having a bottom-closed cylindrical magnetic circuit holder 2 in which a bottom plate 9, a ring-shaped magnet 13 and a top plate 14 are sequentially put in and fixed.

The frame 3 is an integral member made of a heat-resistant plastic material such as engineering plastic, and includes a mount portion 4 for fixing the outer circumferential margin of a diaphragm 17 and a mounting surface 5 for mounting the speaker, for example to an automobile door, which are integrally continuous from the upper open end of the magnet circuit holder 2 via a larger-diameter portion. The frame 3 further includes a positioning projection 6 standing upwardly from the center of the bottom surface 2*a* of the magnetic circuit holder 2 and a plurality of engaging projections 8 extending from the inner surface of the magnetic circuit holder 2 near the open upper end thereof and spaced apart from each other by a predetermined distance. Each of the engaging projections 8 has a lower surface defining a slanted surface 7 which slopes down toward the bottom from one end to the other in the circumferential direction. The entirety of the frame 3 is integrally molded of an engineering plastic or other plastic material having a good resistance to heat.

The bottom plate 9 is made of a magnetic material and includes a center pole 10 integrally standing upward at the center thereof. The bottom plate 9 also includes a circular rib-shaped magnet guide 11 concentrically surrounding the center pole 10, and a positioning recess 12 engageable with the positioning projection 6 on the bottom surface 2*a* of the magnetic circuit holder 2 of the frame 3.

The ring-shaped magnet 13 is a ferrite-based permanent magnet whose inner circumferential surface engages with the magnet guide 11 on the upper surface of the bottom plate 9. The outer diameter of the magnet 13 is such that a given distance is provided between the outer circumferential surface thereof and the inner circumferential surface of the magnet circuit holder 2 when the magnet 13 is mounted in the magnet circuit holder 2.

The top plate 14 is made of a magnetic material. In the specific embodiment illustrated, the top plate 14 has the form of a disk having a center hole 15 through which the center pole 10 of the bottom plate 9 can pass. The top plate 14 has three engaging portions 16 integrally extending in horizontal directions from its outer circumferential edge for engaging the engaging projections 8 of the frame 3. Thus the engaging projections 8 of the frame 3 and the engage portions 16 of the top plate 14 make a so called bayonet coupling mechanism.

The top plate 14 may alternatively have a rectangular outer contour such that its corners behave as the engaging portions.

Explained below is a method for manufacturing a speaker 1 by using the components explained above.

The process is started by putting the bottom plate 9 on the bottom surface 2*a* of the magnetic circuit holder 2 of the frame 3 in a proper positional relationship which is readily attained by engagement with the positioning recess 12 of the bottom plate 9 and the positioning projection 6 of the frame 3.

After that, the magnet 13 is put on the bottom plate 9 in the magnetic circuit holder 2 by passing the center pole 10 of the bottom plate 9 through the center hole of the magnet 13 and by engaging the inner surface of the magnet 13 with the annular magnet guide 11 of the bottom plate 9. Thereafter, the top plate 14 is put on the magnet 13 in the magnetic circuit holder 2 by passing the center pole 10 of the bottom plate 9 through the center hole 15 of the top plate 14.

Figure 4:
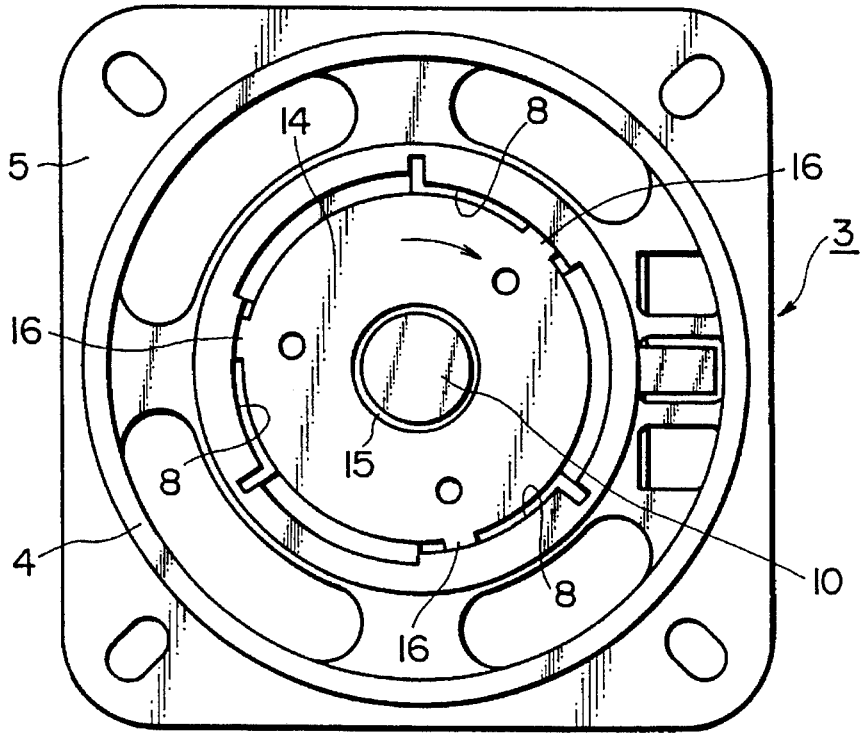
FIG. 4 is a plan view of a frame and a magnetic circuit mounted therein.

Then the top plate 14 is first brought to an angular position relative to the magnet circuit holder 2 where the engaging portions 16 of the top plate 14 do not overlap the engaging projections 8 of the magnetic circuit holder 2. Thereafter, the top plate 14 is pressed down such that each engaging portion 16 comes to a height substantially lower than the height of the one end of the slanted surface of each engaging projection 8, and is then rotated in the direction shown by the arrow in FIG. 4. During this rotation, the engaging portions 16 first come into engagement with initial ends of the slanted lower surfaces 7 of the engaging projections 8 which are remotest from the bottom of the magnetic circuit holder 2 and move further while sliding along and are gradually urged down by the slanted surfaces 7 of the engaging projections 8 until reaching the other ends of the slanted lower surfaces 7 of the engaging projections 8 which are closest to the bottom of the magnetic circuit holder 2. The engaging portions 16 of the top plate 14 and the engaging projections 8 of the magnet circuit holder 2 thus make a bayonet coupling therebetween. As a result, when the engaging portions 16 reaches the other ends of the slanted lower surfaces 7 of the engaging projections 8, a maximum downward compression of the top plate 14 is attained such that the bottom plate 9 and the magnet 13 in the magnet circuit holder 2 are tightly held under the top plate 14 and in the magnet circuit holder 2 without looseness. Thus the magnet circuit made of the bottom plate 9, magnet 13 and top plate 14 can be firmly fixed in the frame 3 without using an adhesive.

Figure 3:
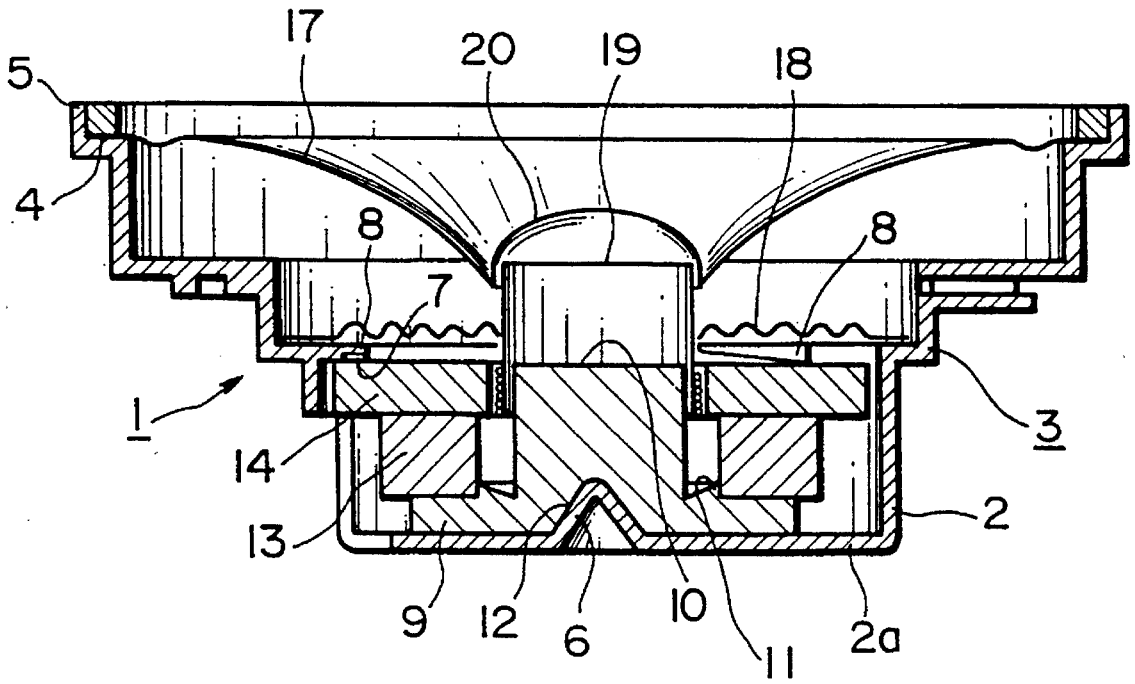
FIG. 3 is a cross-sectional view of a speaker obtained by a method according to the invention.

FIG. 3 shows the speaker 1 assembled by the manufacturing method explained above, in which reference numeral 17 refers to a diaphragm, 18 is a damper, 19 to a coil bobbin having a voice coil wound thereon, and 20 to a dust cap.

In the speaker according to the invention, since the magnetic circuit is fixed in the magnetic circuit holding portion integrally molded of a plastic resin by sequentially mounting the bottom plate, the ring-shaped magnet and the top plate and by engaging the engaging portions of the top plate with the engaging projections at the open end of the magnetic circuit holding portion by the bayonet coupling, the magnetic circuit can be assembled without using an adhesive, and can readily be disassembled to replace a defective element, if any, by a proper one.

In the speaker manufacturing method according to the invention, after sequentially mounting the bottom plate, the ring-shaped magnet and the top plate in the magnetic holding portion molded of a plastic resin, then by engaging the engaging portions of the top plate with the engaging projections at the open end of the magnetic circuit holding portion by the very simple means, i.e., the bayonet coupling, the magnetic circuit can be firmly fixed to the frame without using an adhesive.

In particular, since the speaker manufacturing method according to the invention can reliably incorporate the magnetic circuit in the frame without using an adhesive, it does not need a container for storing an adhesive and removes one or more steps related to an adhesive, such as care of the adhesive and drying the adhesive. Therefore, the method much more simplifies and rationalizes the manufacturing process.

Moreover, the use of the positioning projection of the magnetic circuit holding portion in combination with the positioning recess of the bottom plate and engagement between the magnet and the use of the magnet guide on the bottom plate greatly facilitate the centering of respective elements when assembling one element on another.

Although the present invention has been described and illustrated in detail, it should be clearly understood that the same is by way of illustration and example only and is not to be taken by way of limitation, the spirit and scope of the present invention being limited only by the terms of the appended claims.

What is claimed is:

1. A speaker, comprising:

a plastic frame having an integrally formed a bottom-closed cylindrical magnetic circuit holding portion for holding a magnetic circuit, a first mounting portion for fixing an outer circumferential edge of a diaphragm above said bottom-closed cylindrical magnetic circuit holding portion, and a second mounting surface for mounting of the frame, said frame further having a positioning projection provided in a central portion on a bottom surface of said bottom-closed cylindrical magnetic circuit holding portion, and a plurality of engaging projections extending from an inner surface of said bottom-closed cylindrical magnetic circuit holding portion at an open end thereof at predetermined intervals, each of said engaging projections defining a slanted lower surface sloping down toward said bottom from one end to another;

a bottom plate having a positioning recess in a central portion of a lower surface for engaging said positioning projection, a center pole in a central portion of an upper surface, and a circular rib at said upper surface to serve as a magnet guide;

a ring-shaped magnet, having an inner circumferential surface engageable with said magnet guide; and a top plate having integrally formed a plurality of engaging portions horizontally extending along an outer circumferential portion for engaging with said engaging projections of said frame.

2. A method for manufacturing a speaker, comprising the steps of:

using a plastic frame having integrally formed, a closed bottom cylindrical magnetic circuit holding portion, a first mounting portion for fixing an outer circumferential edge of a diaphragm above said closed bottom cylindrical magnetic circuit holding portion, a plurality of engaging projections extending from an inner surface of said closed bottom cylindrical magnetic circuit holding portion, a second mounting surface for enabling mounting of the frame, and a positioning projection in a central portion on a bottom surface;

concentrically putting a bottom plate, which has a magnet guide in an upper surface, a positioning recess in a central portion at a bottom surface, and a center pole, by engaging said positioning recess with said positioning projection of said closed bottom cylindrical magnetic circuit holding portion;

putting a ring-shaped magnet on said bottom plate by utilizing said magnet guide of said bottom plate;

putting on said magnet a top plate having a plurality of engaging portions horizontally extending along the outer circumferential portion thereof by using said center pole as a guide such that said engaging portions of the top plate are offset in a rotational direction relative to said engaging projections; and rotating said top plate in a predetermined direction with respect to the frame such that said engaging portions of the top plate engage with and move along slanted surfaces defined by lower surfaces of said engaging projections of the frame until said top plate is urged to a substantially maximum downward position and tightly holds said ring-shaped magnet in the closed bottom cylindrical magnetic circuit holding portion wherein a magnetic circuit formed of said bottom plate, said ring-shaped magnet, and said top plate is firmly fixed in said frame.

3. The speaker according to claim 1, wherein:

the top plate comprises a magnetic material.

4. The speaker according to claim 1, wherein:

the top plate has a rectangular outer contour such that its corners serve as said engaging portions thereof.

5. The speaker according to claim 4, wherein:

the top plate comprises a magnetic material.

6. The speaker according to claim 1, wherein:

the bottom plate comprises a magnetic material.

7. The speaker according to claim 3, wherein:

the bottom plate comprises a magnetic material.

8. The speaker according to claim 4, wherein:

the bottom plate comprises a magnetic material.

9. The speaker according to claim 5, wherein:

the bottom plate comprises a magnetic material.

10. The method according to claim 2, wherein:

the top plate comprises a magnetic material.

11. The method according to claim 2, wherein:

the top plate has a rectangular outer contour such that its corners serve as said engaging portions thereof.

12. The method according to claim 10, wherein:

the top plate has a rectangular outer contour such that its corners serve as said engaging portions thereof.

13. The method according to claim 2, wherein:

the bottom plate comprises a magnetic material.

14. The method according to claim 10, wherein:

the bottom plate comprises a magnetic material.

15. The method according to claim 11, wherein:

the bottom plate comprises a magnetic material.

16. The method according to claim 12, wherein:

the bottom plate comprises a magnetic material.

* * * * *